US012130056B2

(12) United States Patent
Nagy et al.

(10) Patent No.: US 12,130,056 B2
(45) Date of Patent: Oct. 29, 2024

(54) THERMOELECTRIC ASSEMBLY SEALING MEMBER WITH VAPOR BARRIER

(71) Applicant: TE Technology, Inc., Traverse City, MI (US)

(72) Inventors: Michael J. Nagy, Traverse City, MI (US); Zakary S. McLennan, Rogers City, MI (US); Paul G. Lau, Traverse City, MI (US)

(73) Assignee: TE Technology, Inc., Traverse City, MI (US)

( * ) Notice: Subject to any disclaimer, the term of this patent is extended or adjusted under 35 U.S.C. 154(b) by 0 days.

(21) Appl. No.: 18/473,525

(22) Filed: Sep. 25, 2023

(65) Prior Publication Data

US 2024/0011680 A1 Jan. 11, 2024

Related U.S. Application Data

(60) Division of application No. 17/034,975, filed on Sep. 28, 2020, now Pat. No. 11,768,017, which is a continuation-in-part of application No. 15/673,964, filed on Aug. 10, 2017, now Pat. No. 10,808,971.

(60) Provisional application No. 62/374,308, filed on Aug. 12, 2016, provisional application No. 62/374,451, filed on Aug. 12, 2016.

(51) Int. Cl.
*F25B 21/02* (2006.01)
*F25B 47/00* (2006.01)

(52) U.S. Cl.
CPC ..... *F25B 21/02* (2013.01); *F25B 47/006* (2013.01); *F25B 2321/02* (2013.01); *F25B 2321/023* (2013.01); *F25B 2321/0251* (2013.01)

(58) Field of Classification Search
CPC .... F25B 21/02; F25B 47/006; F25B 2321/02; F25B 2321/023; F25B 2321/0251
USPC ..... 62/3.2
See application file for complete search history.

(56) References Cited

U.S. PATENT DOCUMENTS

| | | | |
|---|---|---|---|
| 2,938,357 | A | 5/1960 | Sheckler |
| 2,997,514 | A | 8/1961 | Roeder, Jr. |
| 3,075,360 | A | 1/1963 | Elfving et al. |
| 3,157,204 | A | 11/1964 | Phillips |
| 3,167,925 | A | 2/1965 | Elfving |

(Continued)

FOREIGN PATENT DOCUMENTS

DE 2009940 A1 9/1970

OTHER PUBLICATIONS

Web page from Kryotherm (www.kryothermtec.com) showing Thermoelectric modules for power generation, understood to be publicly available prior to Aug. 12, 2016.

(Continued)

*Primary Examiner* — Joel M Attey
(74) *Attorney, Agent, or Firm* — Gardner, Linn, Burkhart & Ondersma LLP

(57) ABSTRACT

A thermoelectric assembly includes a thermoelectric module having a hot side and a cold side, where a heat sink is coupled with the hot side of the thermoelectric module and a cold sink is coupled with the cold side of the thermoelectric module. A gasket is disposed between the heat sink and the cold sink and extends around a portion of the thermoelectric module. A vapor barrier is attached to and covers an outer surface of the gasket to prevent water vapor from penetrating the outer surface of the gasket.

23 Claims, 6 Drawing Sheets

(56) References Cited

U.S. PATENT DOCUMENTS

| | | | | |
|---|---|---|---|---|
| 3,212,274 | A | 10/1965 | Eidus | |
| 3,225,549 | A | 12/1965 | Elfving | |
| 3,229,469 | A | 1/1966 | Katon | |
| 3,246,920 | A | 4/1966 | Pall | |
| 3,325,312 | A | 6/1967 | Sonntag, Jr. | |
| 3,390,018 | A | 6/1968 | Habdas | |
| 3,411,955 | A | 11/1968 | Weiss | |
| 3,472,523 | A | 10/1969 | Rentschler et al. | |
| 3,489,520 | A | 1/1970 | Chartouni et al. | |
| 3,873,102 | A | 3/1975 | Lotze et al. | |
| 4,168,394 | A | 9/1979 | Yuey | |
| 4,383,414 | A | 5/1983 | Beitner | |
| 4,493,939 | A | 1/1985 | Blaske et al. | |
| 4,587,810 | A * | 5/1986 | Fletcher | F25C 1/22 62/340 |
| 4,782,664 | A | 11/1988 | Sterna et al. | |
| 4,829,771 | A | 5/1989 | Koslow et al. | |
| 4,831,083 | A | 5/1989 | Geri et al. | |
| 5,032,472 | A | 7/1991 | Michel et al. | |
| 5,047,212 | A | 9/1991 | Blades et al. | |
| 5,275,957 | A | 1/1994 | Blades et al. | |
| 5,344,493 | A | 9/1994 | Jackson | |
| 5,367,879 | A | 11/1994 | Doke et al. | |
| 5,501,076 | A | 3/1996 | Sharp, III et al. | |
| 5,540,450 | A | 7/1996 | Hayashi et al. | |
| 5,564,716 | A | 10/1996 | Onoue et al. | |
| 5,605,048 | A | 2/1997 | Kozlov et al. | |
| 5,607,167 | A | 3/1997 | Franckx | |
| 5,640,407 | A | 6/1997 | Freyman et al. | |
| 5,720,487 | A | 2/1998 | Kato | |
| 5,738,498 | A | 4/1998 | Allington et al. | |
| 5,813,233 | A | 9/1998 | Okuda et al. | |
| 5,822,993 | A | 10/1998 | Attey | |
| 5,841,064 | A | 11/1998 | Maekawa et al. | |
| 5,931,000 | A | 8/1999 | Turner et al. | |
| 5,939,464 | A | 8/1999 | Wang | |
| 6,530,231 | B1 | 3/2003 | Nagy et al. | |
| 6,662,571 | B1 | 12/2003 | Nagy et al. | |
| 8,650,886 | B2 * | 2/2014 | Wilcoxon | F04B 17/00 165/69 |
| 2004/0050100 | A1 | 3/2004 | Ungerleider | |
| 2012/0055042 | A1 | 3/2012 | Polegato Moretti | |
| 2013/0335285 | A1 * | 12/2013 | Tarkington | H01Q 1/44 174/351 |
| 2014/0216807 | A1 | 8/2014 | Liu et al. | |
| 2015/0034138 | A1 | 2/2015 | Himmer | |
| 2015/0335921 | A1 | 11/2015 | Hagen et al. | |

OTHER PUBLICATIONS

Web pages from Nippon Electric Glass Co., Ltd. (https://www.neg.co.jp/en/product/ep/glass-ribbon).

Product information brochure for Nippon Electric Glass taken from https://www.neg.co.jp/en/product/ep/glass-ribbon.

Web pages from JNS Glass & Coatings (https://www.jnsglass.com/ultra-thin-glass).

Panasonic U-Vacua Vacuum Insulation Panels product brochure, downloaded from https://b2b-api.panasonic.eu/file_stream/pids/fileversion/3247.

* cited by examiner

THERMOELECTRIC ASSEMBLY SEALING MEMBER WITH VAPOR BARRIER

CROSS-REFERENCE TO RELATED APPLICATIONS

The present application is a divisional application of U.S. application Ser. No. 17/034,975, filed Sep. 28, 2020, which is a continuation-in-part of U.S. application Ser. No. 15/673,964, filed Aug. 10, 2017, now U.S. Pat. No. 10,808,971, which claims the benefit and priority of U.S. provisional application Ser. No. 62/374,451, filed Aug. 12, 2016, and U.S. provisional application Ser. No. 62/374,308, filed Aug. 12, 2016, all of which are hereby incorporated herein by reference in their entireties.

FIELD OF THE INVENTION

The present invention relates generally to the field of thermoelectric devices, and more particularly to insulated seals or gasket arrangements for thermoelectric assemblies.

BACKGROUND OF THE INVENTION

Thermoelectric assemblies are solid state heat pumps that extract or add heat to an object or region, so they can be used for cooling or heating, depending on the specific application. They can also be used to generate electrical current. Such thermoelectric assemblies are currently used in a wide variety of applications in order to affect the thermal environment of a particular object or region. In its broadest form, a thermoelectric assembly includes a cold side heat exchanger, or "cold sink," and a hot side heat exchanger, or "heat sink." A thermoelectric module, often referred to as a Peltier Effect Module, is positioned or sandwiched between the inner surfaces of both the cold sink and the heat sink. The thermoelectric module uses electrical current to create a temperature difference between the heat sink and cold sink, or can generate electrical current from an imposed temperature difference between the heat sink and cold sink. Variations in, and additions to, the basic components enable a thermoelectric assembly to be tailored to a specific application.

The reliability of all types of thermoelectric modules and also the efficiency of the thermoelectric assembly is dependent upon its ability to effectively transfer heat between the cold sink and the heat sink. This ability is severely compromised by the introduction of water vapor to the thermoelectric module. Specifically, when water vapor is allowed to condense within the thermoelectric module, interaction between the condensed water and the thermoelectric module causes the module to corrode, and over time, leads to catastrophic failure.

Oftentimes, thermoelectric cooling assemblies are used to cool below dew point temperatures, such that condensation may form on cold portions of the thermoelectric assembly. It is common to provide a sealing member, such as a foam gasket, that acts to insulate between a heat sink and a cold sink of the thermoelectric assembly, thereby generally surrounding the thermoelectric module to help reduce the amount of water that condenses within the assembly. However, these gaskets can be somewhat permeable to water vapor, and thus over time, water can eventually enter into the cooling assembly. This water vapor can condense around the thermoelectric modules and degrade the performance of the cooling assembly, such as due to degraded electrical connections and electrical corrosion, degraded insulation properties of the gasket, and a loss of thermal capacity of the cooler from internal/parasitic heat transport as water evaporates and condenses between the hot and cold surface within the cooling assembly.

SUMMARY OF THE INVENTION

The present invention provides a thermoelectric or Peltier assembly that includes a glass vapor barrier disposed generally around a perimeter of an insulation vapor seal or gasket that is disposed between a cold sink and a heat sink of the assembly. The glass vapor barrier may be a glass sheet or glass film or ribbon that is sufficiently thin to prevent significant thermal conduction between a cold sink and a heat sink of the assembly through the glass vapor barrier. The glass vapor barrier may, for example, include a thin glass sheet or film adhered or otherwise bonded to the outside of the gasket. The glass vapor barrier acts to prevent or reduce the amount of water vapor or other liquid condensation that may penetrate or permeate through or around the gasket. The glass vapor barrier is thus configured to have a low thermal conduction to limit the amount of heat that is transferred from the heat sink back to the cold sink, such as by providing a glass vapor barrier of a thin gauge material with a low thermal conductivity. Accordingly, the glass vapor barrier also allows the insulation vapor seal or gasket to include a permeable material, such as foam, without substantially affecting performance of the thermoelectric cooling assembly.

According to one aspect of the present invention, a thermoelectric assembly includes a thermoelectric module having a hot side and a cold side, where a heat sink is coupled with the hot side of the thermoelectric module and a cold sink is coupled with the cold side of the thermoelectric module. A gasket is disposed between the heat sink and the cold sink and extends around a portion of the thermoelectric module. A vapor barrier layer substantially covers an outer surface of the gasket to prevent water vapor from penetrating the outer surface of the gasket, where the vapor barrier layer has zero permeability to water vapor and may, for example, be constructed of a glass or ceramic material.

According to another aspect of the present invention, a sealing member is provided for a thermoelectric assembly having a thermoelectric module disposed between a heat sink and a cold sink. A gasket is configured to be disposed between the heat sink and the cold sink, where the gasket has a first interfacing surface that is configured to engage the heat sink and a second interfacing surface that is configured to engage the cold sink. Seals, such as a sealant or o-rings, may be disposed at the interfacing surfaces. The gasket also includes an opening that extends between the first and second interfacing surfaces and that provides an interior space that is configured to surround a periphery of the thermoelectric module. A vapor barrier is disposed at and covers an outer peripheral surface of the gasket that extends between the first and second interfacing surfaces around the gasket, where the vapor barrier is constructed as one or more layers of material having zero permeability to water vapor. The vapor barrier layer may be constructed as a glass or ceramic vapor barrier and be configured to prevent water vapor from penetrating into the interior space surrounded by the gasket.

According to yet another aspect of the present invention, a sealing member is provided for a thermoelectric assembly having a thermoelectric module disposed between a heat sink and a cold sink. A metalized gasket member is configured to be disposed between the heat sink and the cold sink, where the metalized gasket member has a first interfacing surface that is configured to engage the heat sink and a second interfacing surface that is configured to engage the cold sink. The metalized gasket member also includes an opening that extends between the first and second interfacing surfaces and that provides an interior space that is configured to surround a periphery of the thermoelectric module. The metalized gasket member is configured to be engaged at the first and second interfacing surfaces, such as via a sealant, to prevent water vapor from penetrating into the interior space surrounded by the metalized gasket member. Optionally, the metalized gasket member may include a single piece of metal or metallized plastic that has a sufficient mechanical strength to replace a foam gasket. A zero permeability vapor barrier may be disposed at the outer or exterior periphery surface of the metalized gasket, such as a metal, glass or ceramic vapor barrier.

Optionally, the thermoelectric assembly may include a sealant or adhesive that is disposed between the glass vapor barrier and the outer surface of the gasket to attach the glass vapor barrier to the gasket and to prevent water vapor from entering between the vapor barrier and the gasket. Also, such a sealant or adhesive may be disposed between an edge of the glass vapor barrier and the heat sink or the cold sink to prevent water vapor from entering between the glass vapor barrier and the gasket. Further, the glass vapor barrier may include a single piece of material that is disposed around and substantially covers an exterior perimeter surface of the gasket, or may be constructed of multiple pieces or sections, as well as may include overlapping portions.

Thus, the glass vapor barrier of the present invention can prevent unwanted deterioration or degradation to the gasket, including to properties of the gasket, such as thermal properties of the gasket, that may result from the water vapor or condensation permeating or forming in or around the insulation vapor seal or gasket. Also, the glass vapor barrier may prevent or limit degradation or corrosion of electrical connections at the thermoelectric modules that would be otherwise caused by the water vapor entering through or around the gasket. Further, the thermal capacity of the cooling assembly may be maintained and the usable life of the thermoelectric assembly prolonged by the glass vapor barrier preventing or inhibiting water from entering the cooling assembly and causing internal/parasitic heat transport or corrosion to the module.

These and other objects, advantages, purposes and features of the present invention will become apparent upon review of the following specification in conjunction with the drawings.

DESCRIPTION OF THE PREFERRED EMBODIMENTS

Figure 1:
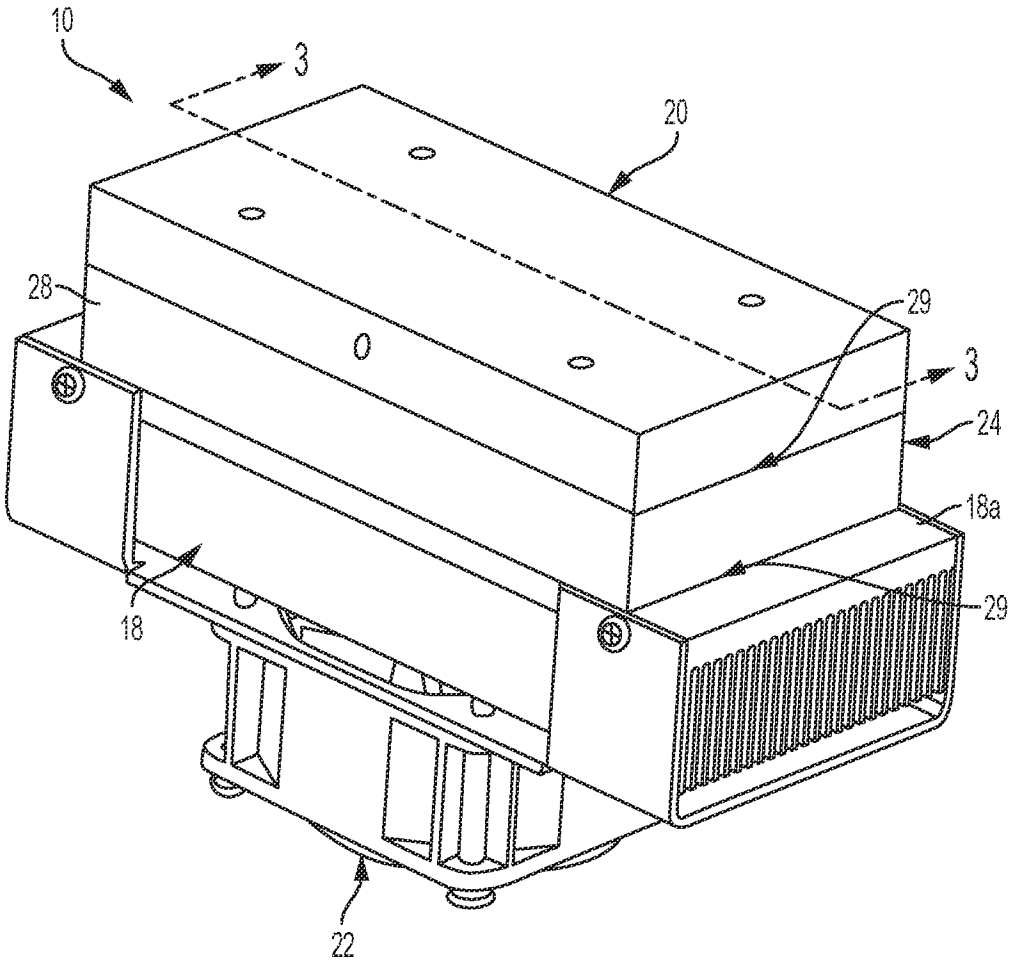
FIG. 1 is an upper perspective view of a thermoelectric assembly having a metal vapor barrier, in accordance with the present invention.

Referring now to the drawings and the illustrative embodiments depicted therein, a thermoelectric assembly 10 includes two thermoelectric modules 12 (FIGS. 2 and 3) that each have a hot surface or side 14 and, on the opposing side, a cold surface or side 16. A contact surface 18*a* of a heat exchanger or heat sink 18 is in contact with the hot side 14 of each of the thermoelectric modules 12 and a contact surface 20*a* of another heat exchanger or a cold plate or sink 20 is in contact with the cold side 16 of each of the thermoelectric modules 12. The opposing side of heat sink 18 from the thermoelectric modules 12 is coupled to an exhaust fan 22. A sealing member 24 surrounds and seals the thermoelectric modules 12. The sealing member 24 includes an insulation vapor seal or gasket 26 that is disposed between the heat sink 18 and the cold sink 20 and extends around each of the thermoelectric modules 12. A metal or metallic vapor barrier 28 is attached and covers an outer surface 26*a* of the gasket 26 to prevent water vapor from penetrating the outer surface 26*a* of the gasket 26. In operation, the cold plate or sink 20 can be in contact (directly or indirectly) with an object or medium which is to be cooled. As the cold sink 20 performs the cooling function, the thermoelectric module 12 thermoelectrically absorbs heat therefrom and transfers the same to the heat sink 18, which is subsequently exhausted to the environment by the exhaust fan 22.

It will be recognized that although two thermoelectric modules 12 are illustrated in the drawings, a single thermoelectric module or additional modules may be provided, and one sealing member or multiple sealing members may be used depending on the arrangement. Also, the illustrated thermoelectric modules 12 may be any thermoelectric module normally employed in thermoelectric assemblies. It is also recognized that the illustrated thermoelectric assembly 10 is one form, specifically, a plate-to-air thermoelectric assembly, and shall not be limiting of the invention. The present invention is also applicable to plate-to-plate thermoelectric assemblies, air-to-air thermoelectric assemblies, or liquid-to-air thermoelectric assemblies and all possible combinations of the like. Thus, it will be understood, that the present invention may be used in conjunction with any form of thermoelectric assembly.

As shown in FIG. 1, the sealing member 24 is positioned in sealing contact with a surface of the heat sink, such as with the contact surface 18*a* of the heat sink 18, and in sealing contact with a surface of the cold sink, such as surface 20*b* (FIGS. 2 and 3) that surrounds the contact surface 20*a* of cold sink 20. The sealing member 24 provides a generally hermetic seal, to inhibit or prevent water vapor from entering the interior area 30 (FIG. 2) within sealing member 24 and condensing on either of the thermoelectric modules 12 which could otherwise cause premature degradation thereof. The illustrated sealing member 24 includes the gasket 26 disposed between the heat sink 18 and the cold sink 20 and extends around a peripheral portion of each of the thermoelectric modules 12 (FIG. 2) that separates the hot and cold sides 14, 16 of the thermoelectric modules 12. As such, a space 30*a* (FIG. 3) may be formed between the inner surface 26*b* of the gasket 26 and the peripheral portions of the thermoelectric modules 12. This space 30*a* may be left as an air barrier, or during assembly may be filled with an insulating filler material, a desiccant, and/or purged with a dry gas.

Figure 2:
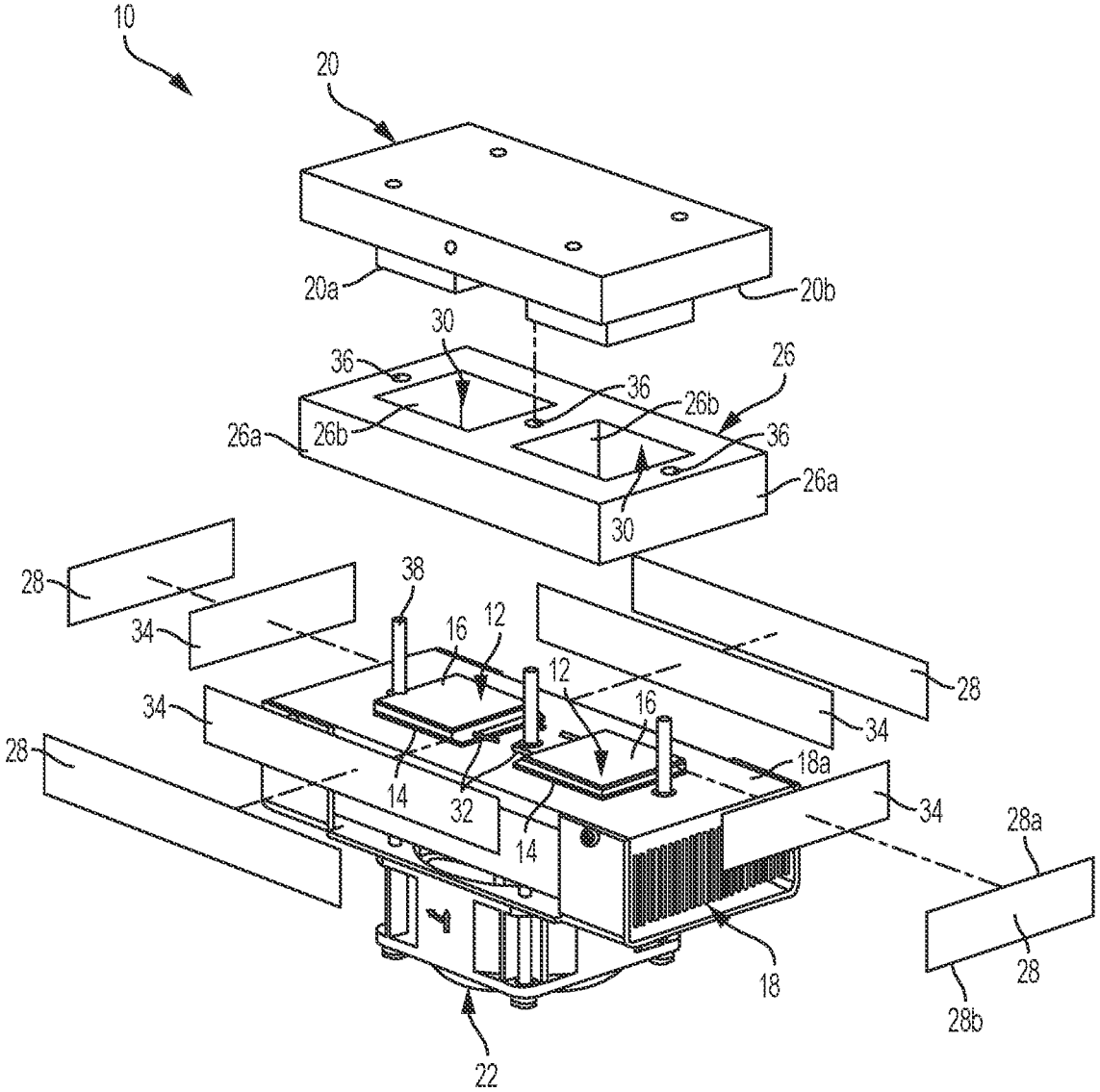
FIG. 2 is an exploded upper perspective view of the thermoelectric assembly having the metal vapor barrier shown in FIG. 1.

The outer surface 26*a* of the gasket 26, as shown in FIG. 2, extends between the heat sink 18 and the cold sink 20 to define an exterior perimeter surface 26*a* of the gasket 26 (FIG. 2). In the illustrated embodiment the exterior perimeter surface or outer surface 26*a* is shown as being perpendicular to the surfaces 18*a* and 20*b*. The vapor barrier 28 of the sealing member 24 is attached to and substantially covers the outer surface 26*a* of the gasket 26 between the heat sink 18 and the cold sink 20 to prevent water vapor from penetrating into and through the outer surface 26*a*. The vapor barrier 28 is a metallic vapor barrier that may comprise at least one of a metalized film, a metal foil, a stainless steel foil, or other thin and preferably metal material or the like. This may include, for example, metalized plastic films, such as Mylar or other metallized plastic or polyester, as well as metalized plastic films used in the packing industry, such as in the food packaging industry. The foil is useful as its water vapor permeability is not temperature dependent like a polymer, and also foil can be applied to generally any type of gasket and can be used without a gasket backing. The material of the vapor barrier 28 is selected to have a low thermal conductivity (such as stainless steel) and/or to be thin to reduce, inhibit or otherwise prevent a thermal conduction path from the heat sink 18 to the cold sink 20. By way of example, the metallic vapor barrier 28 may be constructed of a metallic material having a low conductivity in the low range of approximately 2.6 W/m·K, such as may be provided by a heat resistant stainless steel alloy, or may be constructed of a metallic material having a higher conductivity up to approximately 250 W/m·K, such as may be provided by pure aluminum. It should be appreciated, however, that utilization of a metallic material having a higher conductivity would additionally necessitate constructing the metallic vapor barrier 28 to be thin to resist heat transfer between the heat sink 18 and cold sink 20. For example, the metallic vapor barrier 28 may be formed by a sputter process, such as on a plastic layer, to have a metallic thickness in the range of 5 to 10 nm. Alternatively, utilization of a metallic material having a lower conductivity may allow or enable use of a thicker vapor barrier 28, such as having a thickness of approximately 10 mm if a rigid structure is desired, as discussed in connection with FIG. 4 below. Thus, the vapor barrier 28 may be configured to be sufficiently thick enough to retain the necessary barrier properties. For example, it is conceivable that a metal material of the vapor barrier 28 may be welded, such as by laser welding, to at least one of the heat sink and the cold sink to adhere and prevent water from getting in between vapor barrier 28 and the gasket 26. In testing, the vapor barrier 28 performed with surprising result to reduce the amount of water entering the exchanger by about seven times.

The illustrated vapor barrier 28 includes four separate pieces that are separately adhered to the outer surface 26*a* of the gasket 26 with a pieces of sealant or adhesive 34. Also, sealant or adhesive can be used to cover top and bottom ends or edges 28*a*, 28*b* of the vapor barrier 28 along the interface 29 (FIG. 1) with the heat sink 18 and cold sink 20 to prevent water from getting in between the vapor barrier 28 and the gasket 26. Further, the interface seams 29 (FIG. 1) between the gasket 26 and the heat sink 18 and/or the cold sink 20 may be covered with an extension of the vapor barrier 28, with seals disposed between the gasket 26 and the heat sink 18 and/or the cold sink 20, such as a sealant or adhesive 34 to further reduce water vapor and other gas permeation into the completed cooling assembly. As such, the pieces of sealant or adhesive 34 can be selected to be an additional vapor barrier that is disposed between the metalized foil or film layer and the gasket. For example, foil may be sealed against heat exchanger surfaces using various sealants, such as Butyl rubber, polyisobutylene rubber, polyurethane and polysulfide sealants, sealants used in the insulated glass industry, or through other techniques, such as but not limited to Silicone rubbers (RTV), epoxies, and acrylic adhesives. This same sealant may be used as a seal between the gasket 26 and the heat sink 18 and/or the cold sink 20. Alternatively, o-rings, or other gaskets, such as elastomeric materials, may be used as seals between the gasket 26 and the heat sink 18 and/or the cold sink 20.

Optionally, the vapor barrier 28 may include an exterior protective coating, such as a film, tape, adhesive, sealant, and/or other cover, which may be applied to or disposed over an exterior surface of the metalized foil or film layer. The exterior coating may function to prevent damage to the foil and/or gasket when handling the completed cooling assembly. Similarly, additional layers of vapor barrier can be placed over the foil or film of the vapor barrier to overlap the seams between the heat exchanger surfaces and/or other seams in the foil. Such additional layer or layers may comprise four separate layers positioned at the four sides of the interface seams 29 between the four exposed surfaces 26*a* and the heat sink 18 and an additional four separate layers positioned at the four interface seams between the four exposed surfaces 26*a* and the cold sink 20. Still further, the vapor barrier 28 may be configured to have multiple layers disposed over or about the entire gasket 26.

It is contemplated that the metallic vapor barrier 28 may alternatively comprise more or fewer pieces, such as a single piece of material, such as film or foil, which can be wrapped completely around the gasket and potentially overlapped in areas, such as at any seams, to promote a better vapor barrier. Also, a foil or metalized film can extend onto and cover portions of the surfaces of the heat sink 18 or cold sink 20 to promote better sealing. Similarly, the vapor barrier 28 may comprise a metallized layer of shrink-wrappable barrier material, such as metalized film, that is heat wrapped, suction wrapped, or otherwise shrink wrapped to the gasket for ease of application. Further, it is contemplated that the vapor barrier may be a one piece stamped or otherwise manufactured enclosure, such as forming a 4-sided box shape, with optional sealing flanges integrated into the shape of the vapor barrier and/or the heat exchanger mating or contact surfaces. For example, the heat sink and/or the cold sink may include a sealing flange integrated with and protruding around the gasket to engage an edge portion of the vapor barrier.

Figure 3:
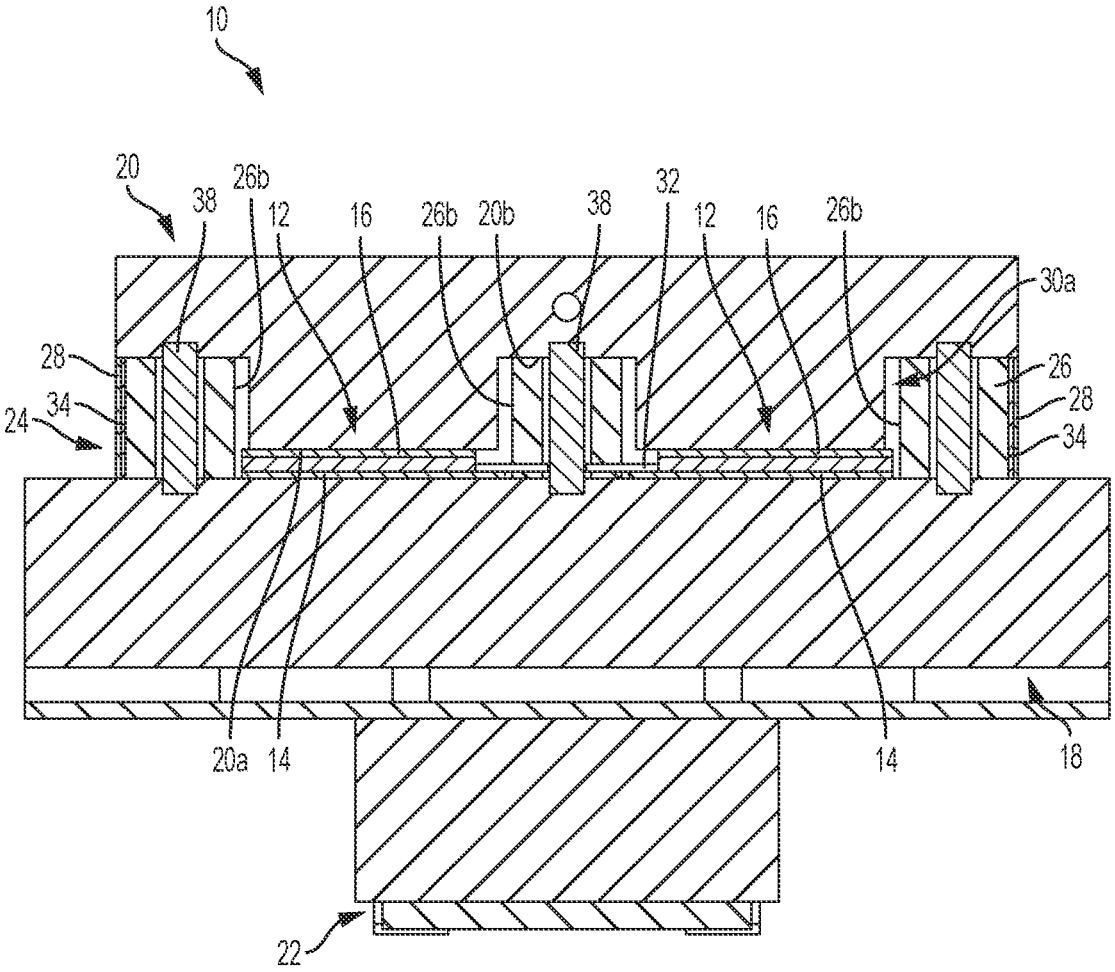
FIG. 3 is a cross-sectional view of the thermoelectric assembly taken at section 3-3 shown in FIG. 1.

As also shown in FIGS. 2 and 3, the wires 32 that power or operate the thermoelectric modules 12 are illustrated entering the peripheral portion of each of the thermoelectric modules 12. As such, the wires 32 can go through or around of the vapor barrier 28, such as through seams of the pieces of the vapor barrier 28 or can go through apertures in the hot or cold sinks 18, 20. If the wires 32 pass through or around the vapor barrier 28, the wires may include sealant around the point of passing through or around the vapor barrier 28. Similarly, if the wires 32 extend to the modules 12 through holes in heat sink 18 or cold sink 20, the holes may also be sealed with sealant or with other means, such as wire feedthroughs and hermetic feedthroughs. Sealing around wires 32 may be further enhanced by using solid, non-stranded wire.

The gasket 26 of the sealing member 24 is illustrated in FIG. 2 having fastener holes 36 that allow screws or bolts 38 or the like to engage between the heat sink 18 and the cold sink 20, such as to compress the gasket 26. It is contemplated that assembly screws can alternatively be placed outside the gasket for improved sealing of assembly. The gasket 26 has a continuous, closed shape that is generally rectangular in the illustrated embodiment, but may have arcuate or curved corners, or even be generally circular or elliptical, to avoid the presence of hard angles which can compromise the ability of sealing member to provide a hermetic seal. A rounded, circular, or elliptical gasket may promote the use of a single vapor barrier disposed about the gasket exterior to reduce the number of pieces or avoid the use of multiple pieces of vapor barrier. It will be understood by those with ordinary skill in the art that although depicted with a rectangular shape, the gasket 26 and corresponding sealing member 24 may assume any shape required by the particular application. For example, depending upon the peripheral dimension of thermoelectric module 12, the gasket 26 may assume a generally circular or oval shape. Further, it will be understood that sealing member 24 may be made to assume any size required by the particular thermoelectric module 20 which is to be sealed.

The gasket 26 may comprise a foam material or other known insulating material, such as a porous and/or non-metallic material. For example, the gasket 26 may be formed in place on the surface of one of the heat exchanger, heat sink or cold sink plates by dispensing sealing or gasket material from a suitable dispensing apparatus or machine in a suitable closed, continuous shape extending around the entirety of one or more thermoelectric modules to be hermetically sealed. Similarly, the gasket 26 may be extruded into a desired shape for use in a thermoelectric assembly as described herein. Other known gaskets and associated thermoelectric assemblies are described in U.S. Pat. Nos. 6,530,231 and 6,662,571, which are hereby incorporated herein by reference in their entireties.

Figure 4:
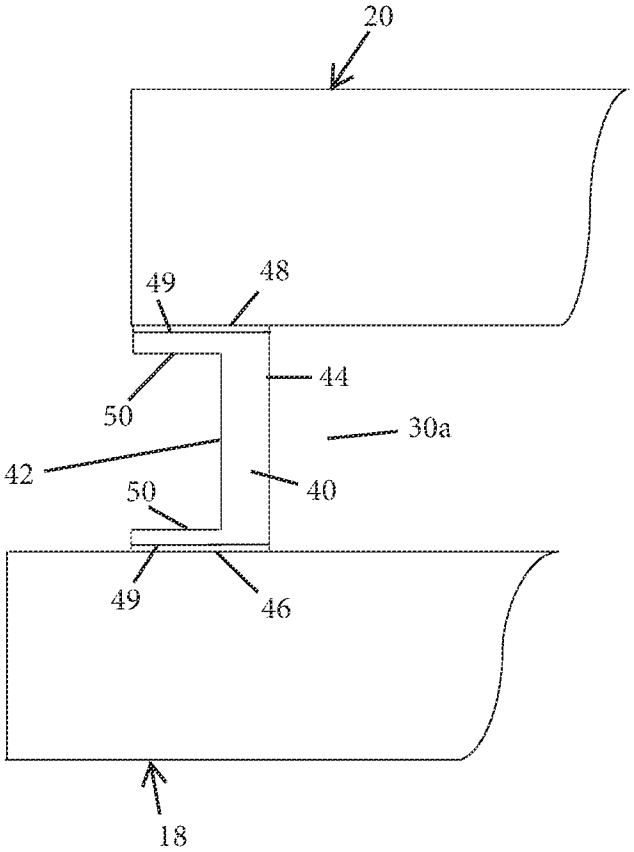
FIG. 4 is a partial cross-sectional view of a thermoelectric assembly having an alternative metal vapor barrier in accordance with another aspect of the present invention.

Optionally, with reference to the embodiment of FIG. 4, a thermoelectric assembly may include a metalized gasket member 40 that can act as the vapor barrier and replace a separate gasket, such as replacing the separate foam gasket 26, between the heat sink 18 and the cold sink 20. Similar in shape to an internal gasket, the metalized gasket member 40 would also include an opening that extends between the first and second interfacing surfaces and that provides an interior space 30*a* that is configured to surround a periphery of the thermoelectric module. Such a metalized gasket member 40 has sufficient mechanical strength and rigidity, either alone or with a ridged backing support, such as a rigid plastic member, to remain fixed in place and be self-supporting when installed and inhibit damage during handling, transportation and operation, as well as withstand any partial compressive forces that may be applied thereto when mounting between the heat sink 18 and the cold sink 40. The metalized gasket member 40 may have either one or both of an exterior peripheral metalized surface 42 extending between the first and second interface surfaces and/or an interior peripheral metalized surface 44 extending between the first and second interface surfaces, where the interior peripheral surface would be directed toward and surround the thermoelectric modules 12. For example, the metalized gasket may comprise a core material, such as a plastic, with an exterior metalized surface 42 and/or an interior metalized surface 44.

Thus, the metalized gasket member 40 has a first interfacing surface 46 that is configured to engage and seal against the heat sink 18 and a second interfacing surface 48 that is configured to engage and seal against the cold sink 20. The engagement at the first and second interfacing surfaces 46, 48 may be provided with a seal 49, where the seal 49 may be configured as a sealant, preferably one of low water vapor permeability, to prevent water vapor from penetrating into the interior space 30*a* surrounded by the gasket 40, and/or alternatively may be provided as an o-ring or other gasket. The metalized gasket member 40 may include or comprise a single piece of metal or metallized plastic that has a sufficient mechanical strength to replace or avoid use of a separate gasket. In the case of a single piece of metal, the metalized gasket member may be stamped from a piece of metal. In the case of a single piece of metallized plastic, the metalized gasket member may be vacuum formed or molded plastic. Such a metalized gasket member may further include an extended interface seam or sealing flange 50, such as an L-shaped or T-shaped flange relative to the sidewall of gasket 40, at both the heat sink and cold sink interfaces, which would improve the sealing between the heat sink and/or cold sink. The flange thus comprises one or more legs extending generally parallel with the surfaces of the heat sink 18 and cold sink 20 and generally perpendicular to the sidewall of the gasket 40.

In the illustrated embodiment the metallic vapor barrier is disposed only about the perimeter of the gasket, or formed therewith, and disposed between the cold sink and heat sink of the assembly to thereby inhibit the amount of water vapor or other liquid condensation that may penetrate or permeate through or around the gasket. It should be appreciated that the water vapor permeability of the metal or metalized vapor barrier is generally zero, but that depending on the thickness thereof may have microscopic pinholes or cracks.

In accordance with an alternative embodiment, another vapor barrier having zero permeability to water vapor, such as the vapor barrier illustrated at 28 in FIGS. 1-3, may be constructed of an alternative material comprising a glass material such as a glass sheet, such as a glass film, a glass ribbon or foil, or other thin glass material. The glass vapor barrier 28 may likewise be affixed to the gasket 26 via an adhesive, as discussed above. In such an embodiment, the material of the glass vapor barrier is selected to have a low thermal conductivity and/or to be thin to reduce, inhibit or otherwise prevent a thermal conduction path from the heat sink 18 to the cold sink 20. It should be appreciated, however, that utilization of a glass material having a higher thermal conductivity would additionally necessitate constructing the glass vapor barrier 28 to be thin to resist heat transfer between the heat sink 18 and cold sink 20. An exemplary glass film may be supplied by Nippon Electric Glass Co., Ltd. of Japan in which the glass film comprises a glass-ribbon that is thin enough whereby it can be bent or rolled up in like manner to resin film, and may be made with a thickness of between 4 micrometers to 50 micrometers. Alternatively, the glass vapor barrier may be thicker and be of various thicknesses or thickness ranges depending on application for use of the thermoelectric assembly, in which case the glass vapor barrier may be flexible, but not as bendable as the noted glass-ribbon, or may even be stiff so as to resist flexing in instances where the glass vapor barrier is even thicker. For example, the glass vapor barrier may be provided in thicknesses of 0.3 mm or less, or in a range of 0.1 mm to 1.1 mm, including ranges of 0.1 mm to 0.3 mm, 0.3 mm to 0.7 mm, 0.7 mm to 1.1 mm. Still further, it may be possible to utilize a glass vapor barrier that is even thicker than 1.1 mm, such as in a range of 0.4 mm to 2 mm, such as depending on the specific constituency of the glass material. From a thermal standpoint, a glass vapor barrier may be employed that is thicker than a comparable metal foil vapor barrier due to the thermal conductivity of glass being much lower than metal.

Figure 5:
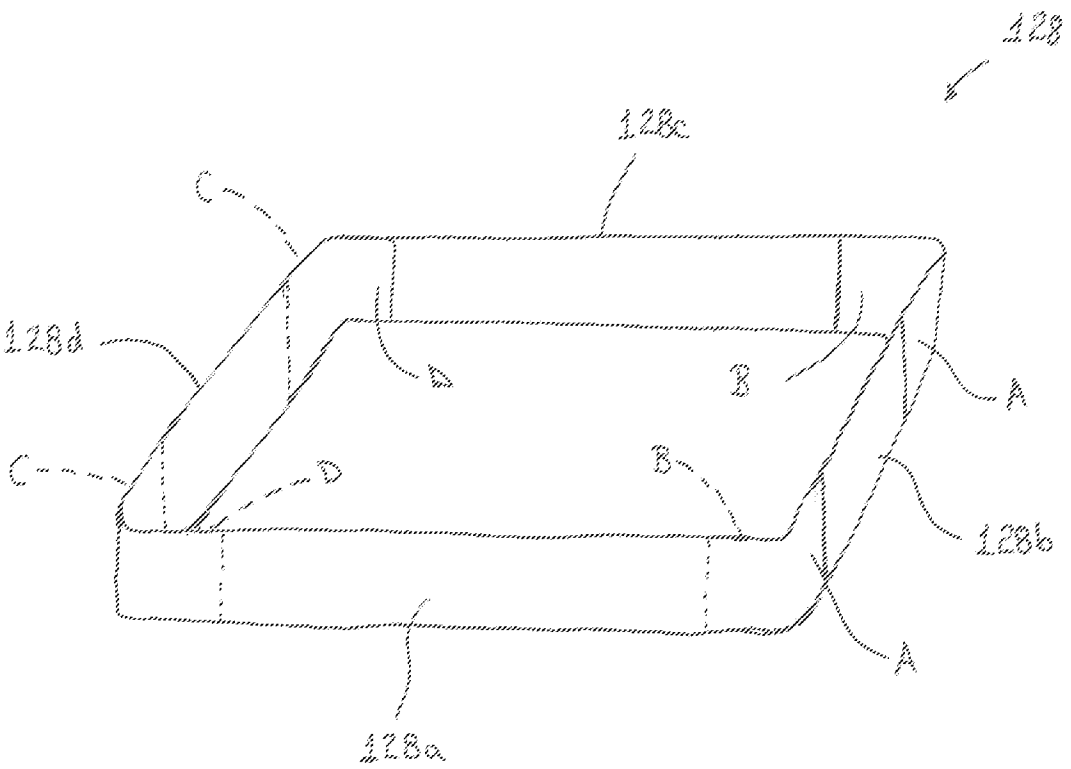
FIG. 5 is a perspective view of a glass vapor barrier arrangement.

The properties of the glass vapor barrier may additionally necessitate changes in the way the vapor barrier 28 is disposed to cover the outer surface 26*a* of the gasket 26 between the heat sink 18 and the cold sink 20. For example, the coefficient of thermal expansion of the glass vapor barrier 28 may result in an unacceptably high differential stress arising between the glass vapor barrier 28 and the gasket 26. To relieve this stress, it may be necessary or preferable to separate the vapor barrier 28 into multiple sections along the outer surface 26*a* of the gasket 26 between the heat sink 18 and the cold sink 20, such as in similar arrangement to that illustrated in FIG. 2 for vapor barrier 28. In this configuration, however, each section of the vapor barrier 28 may be disposed such that it overlaps with another section of the vapor barrier 28 to reduce the amount of water vapor penetrating into and through the outer surface 26*a*. For example, and with reference to FIG. 2, in the glass film vapor barrier embodiment, one or both end portions of each of the four sections of vapor barrier 28 shown being disposed about the exterior perimeter of gasket 26 may extend so as to wrap around a given corner of gasket 26 so as to be disposed at an adjacent side of gasket 26, whereby the sections of glass film vapor barrier will overlap with adjacent sections. This is illustrated, for example, in FIG. 5 in which a vapor barrier 128 is illustrated as would be disposed about a gasket, such as gasket 26, where vapor barrier 128 includes four overlapping glass film vapor barrier sections 128*a*, 128*b*, 128*c* and 128*d*. As there shown ends A of sections 128*a* and 128*c* overlap with section 128*b*, and ends B of section 128*b* correspondingly overlap with sections 128*a* and 128*c*. Likewise, opposite ends C of sections 128*a* and 128*c* overlap with section 128*d*, and opposite ends D of section 128*d* correspondingly overlap with sections 128*a* and 128*c*. As shown, the end portions of the sections 128*a*, 128*b*, 128*c* and 128*d* do not overlap the entire length of the adjacent section corresponding to the length of a side of the gasket about which vapor barrier 128 is disposed. It should be appreciated, however, that alternative arrangements of overlapping sections may be employed, such as one overlapping end per section. It should be further appreciated that glass film vapor barriers may be made from one piece or multiple sections, and that individual sections may cover one or more sides of a gasket member.

As noted, multiple individual glass vapor barrier sections may be employed where such sections are sized according to the given side of the gasket to which it will be applied without bending about a corner of the gasket, such as illustrated in FIG. 2. This arrangement may be utilized, for example, in instances where the glass vapor barrier is not flexible or the flexibility is limited to an extent that it would crack or break if attempting to bend or form the glass vapor barrier around an angular section of the gasket to which it is being applied, for example, where two of the outer sides of the gasket meet to form a corner of the gasket. In such an embodiment the end portions would not extend over or about the corner of the gasket, but rather each section would be sized according to the given side of the gasket to which it is applied. Such an embodiment may promote easier manufacturing and/or enable the use of lower cost glass, such as thicker glass. In embodiments in which the glass vapor barrier sections are sized according to the given side of the gasket to which it will be applied, the corners at which the separate sections are adjacent or abut to form seams may be sealed, such as with a sealant or with a metal vapor barrier material applied to the outside of the glass vapor barrier section. The metal vapor barrier applied over the glass vapor barrier may be, for example, a metal foil tape or a metal foil adhered to the glass with an adhesive, and may comprise separate sections applied just at the corners or seams of the glass vapor barrier sections, or may be disposed about the entire perimeter of the glass vapor barrier sections.

Figure 6:
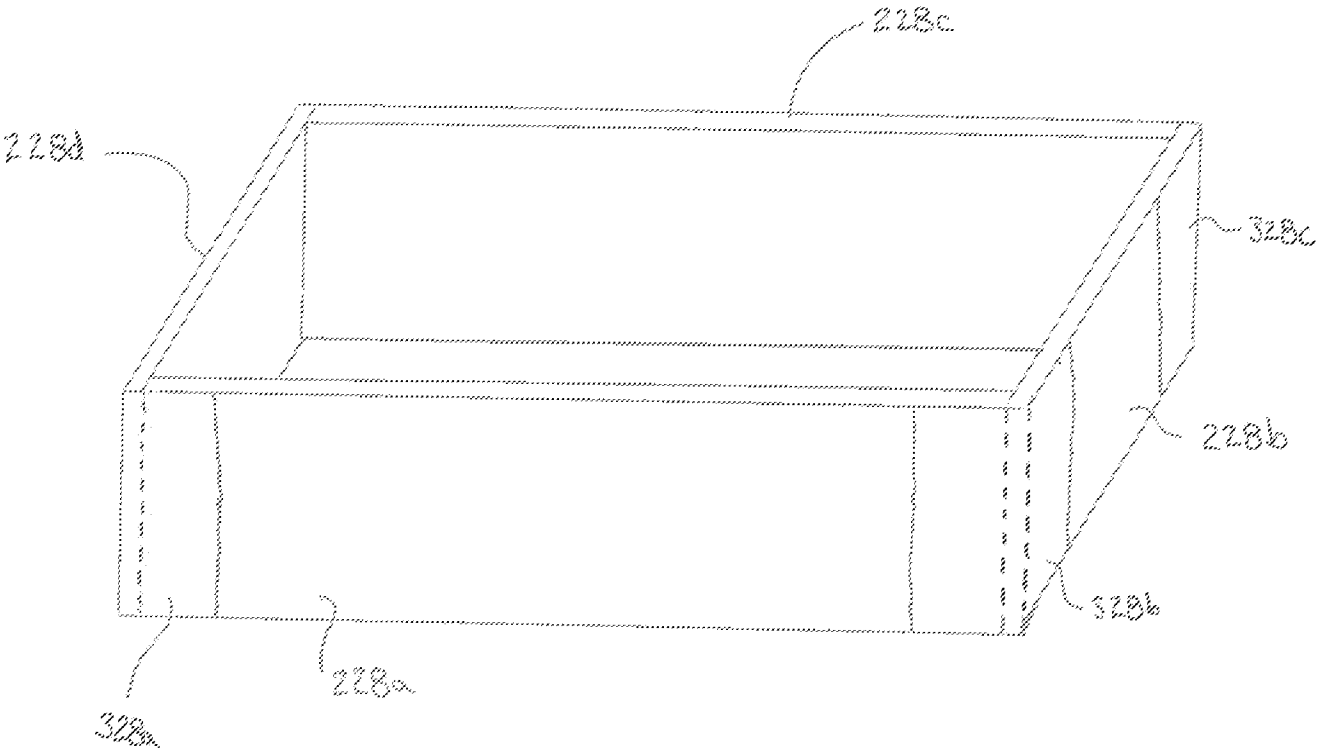
FIG. 6 is a perspective view of an alternatively arranged vapor barrier arrangement.

With reference to FIG. 6, multiple sections of glass vapor barrier 228*a*, 228*b*, 228*c* and 228*d* are illustrated that are sized according to the side of a gasket, such as gasket 26 above, to which they would be applied. In the embodiment of FIG. 6 the sections 228*b* and 228*d* overlap the ends of sections 228*a*, 228*c*. Alternatively, however, the sections 228*b*, 228*d* would not need to overlap as shown. FIG. 6 further illustrates metalized vapor barrier sections 328*a*, 328*b*, 328*c* applied to the outside corners (fourth corner not visible in view of FIG. 6) to thereby seal the seams of the adjacent glass vapor barrier sections 228*a*, 228*b*, 228*c* and 228*d*.

In still a further alternative, another vapor barrier having zero permeability to water vapor, such as the vapor barrier illustrated at 28 in FIGS. 1-3, may be constructed of an alternative material comprising a ceramic material such as a ceramic sheet, such as a ceramic film, a ceramic ribbon or foil, or other thin ceramic material. The ceramic vapor barrier 28 may likewise be affixed to the gasket 26 via an adhesive, as discussed above. In such an embodiment, the material of the ceramic vapor barrier is selected to have a low thermal conductivity and/or to be thin to reduce, inhibit or otherwise prevent a thermal conduction path from the heat sink 18 to the cold sink 20. It should be appreciated, however, that utilization of a ceramic material having a higher thermal conductivity would additionally necessitate constructing the ceramic vapor barrier 28 to be thin to resist heat transfer between the heat sink 18 and cold sink 20. Alternatively, the ceramic vapor barrier may be thicker and be of various thicknesses or thickness ranges depending on application for use of the thermoelectric assembly, such as in the thickness ranges discussed above regarding the glass ceramic vapor barrier. From a thermal standpoint, a ceramic vapor barrier may be employed that is thicker than a comparable metal foil vapor barrier due to the thermal conductivity of ceramic being much lower than metal.

The properties of the ceramic vapor barrier may additionally necessitate changes in the way the vapor barrier 28 is disposed to cover the outer surface 26*a* of the gasket 26 between the heat sink 18 and the cold sink 20. For example, the coefficient of thermal expansion of the ceramic vapor barrier 28 may result in an unacceptably high differential stress arising between the ceramic vapor barrier 28 and the gasket 26. To relieve this stress, it may be necessary or preferable to separate the vapor barrier 28 into multiple sections along the outer surface 26*a* of the gasket 26 between the heat sink 18 and the cold sink 20, such as in similar arrangement to that illustrated in FIG. 2 for vapor barrier 28.

It should be further appreciated that ceramic film vapor barriers may be made from one piece or multiple sections, and that individual sections may cover one or more sides of a gasket member. For example, in like manner to that as discussed above, multiple individual ceramic vapor barrier sections may be employed where such sections are sized according to the given side of the gasket to which it will be applied without bending about a corner of the gasket, such as illustrated in FIG. 2. This arrangement may be utilized, for example, in instances where the ceramic vapor barrier is not flexible or the flexibility is limited to an extent that it would crack or break if attempting to bend or form the ceramic vapor barrier around an angular section of the gasket to which it is being applied, for example, where two of the outer sides of the gasket meet to form a corner of the gasket. In such an embodiment each section would be sized according to the given side of the gasket to which it is applied. Such an embodiment may promote easier manufacturing and/or enable the use of lower cost ceramic, such as thicker ceramic.

As understood from FIG. 6, in embodiments in which the ceramic vapor barrier sections are sized according to the given side of the gasket to which it will be applied, the corners at which the separate sections are adjacent or abut to form seams may be sealed, such as with a sealant or with a metal vapor barrier material applied to the outside of the ceramic vapor barrier section. The metal vapor barrier applied over the ceramic vapor barrier may be, for example, a metal foil tape or a metal foil adhered to the ceramic with an adhesive, and may comprise separate sections applied just at the corners or seams of the ceramic vapor barrier sections, or may be disposed about the entire perimeter of the ceramic vapor barrier sections.

It should be appreciated that, like the metal or metalized vapor barrier discussed above, the water vapor permeability of the glass vapor barrier and ceramic vapor barrier is generally zero, but that depending on the thickness thereof may have microscopic pinholes or cracks.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A thermoelectric assembly comprising:

a thermoelectric module having a hot side and a cold side;

a heat sink coupled with the hot side of the thermoelectric module;

a cold sink coupled with the cold side of the thermoelectric module;

a gasket disposed between the heat sink and the cold sink and extending around a portion of the thermoelectric module; and a vapor barrier substantially covering an outer surface of the gasket, wherein the vapor barrier comprises a ceramic vapor barrier and has zero permeability to water vapor to prevent water vapor from penetrating the outer surface of the gasket, wherein the vapor barrier is attached at the outer surface of the gasket and extends between the heat sink and the cold sink.

2. The thermoelectric assembly of claim 1, wherein the vapor barrier further comprises a glass vapor barrier.

3. The thermoelectric assembly of claim 1, wherein an adhesive sealant is disposed between the vapor barrier and the outer surface of the gasket to adhere the vapor barrier to the gasket.

4. The thermoelectric assembly of claim 1, wherein the outer surface of the gasket is disposed around a periphery of the thermoelectric module and extends between the heat sink and the cold sink to define an exterior perimeter surface of the gasket.

5. The thermoelectric assembly of claim 1, wherein the gasket comprises a foam material, and wherein the vapor barrier is adhered to the outer surface of the gasket.

6. The thermoelectric assembly of claim 1, wherein the ceramic vapor barrier comprises a plurality of sections.

7. The thermoelectric assembly of claim 6, wherein an end of one section of ceramic vapor barrier overlaps with an adjacent section of ceramic vapor barrier.

8. The thermoelectric assembly of claim 1, wherein the ceramic vapor barrier includes an exterior protective coating disposed over the ceramic vapor barrier.

9. The thermoelectric assembly of claim 8, wherein the exterior protective coating comprises at least one of a film, tape, adhesive, and sealant.

10. The thermoelectric assembly of claim 1, wherein the ceramic vapor barrier comprises multiple sections sized according to a given side of the gasket to which each section will be disposed.

11. The thermoelectric assembly of claim 10, wherein a metalized vapor barrier is applied to outer surfaces of adjacent ceramic vapor barrier sections to seal a seam there between.

12. A thermoelectric assembly having a sealing member, and a thermoelectric module disposed between a heat sink and a cold sink, said sealing member comprising:

a gasket configured to be disposed between the heat sink and the cold sink, wherein the gasket comprises a first interfacing surface configured to engage the heat sink and a second interfacing surface configured to engage the cold sink, and wherein the gasket comprises an opening that extends between the first and second interfacing surfaces and that provides an interior space that is configured to surround a periphery of the thermoelectric module; and a vapor barrier layer disposed at and covering an outer peripheral surface of the gasket that extends between the first and second interfacing surfaces around the gasket, wherein the vapor barrier layer is configured to prevent water vapor from penetrating into the interior space surrounded by the gasket, wherein the vapor barrier layer comprises a ceramic vapor barrier that is attached at the outer peripheral surface of the gasket and is configured to span between the heat sink and the cold sink of the thermoelectric assembly.

13. The thermoelectric assembly of claim 12, wherein a sealant is disposed between the vapor barrier layer and the outer peripheral surface of the gasket to attach the vapor barrier layer to the gasket and to prevent water vapor from entering between the vapor barrier layer and the gasket.

14. The thermoelectric assembly of claim 12, wherein the gasket comprises a foam gasket.

15. The thermoelectric assembly of claim 12, wherein the vapor barrier layer comprises a single piece that is disposed around and substantially covers the outer peripheral surface of the gasket.

16. The thermoelectric assembly of claim 12, wherein the vapor barrier layer comprises multiple sections, and wherein each vapor barrier section is adhered to the outer peripheral surface of the gasket.

17. The thermoelectric assembly of claim 16, wherein each vapor barrier section is sized according to a given side of the gasket to which each vapor barrier section will be disposed.

18. The thermoelectric assembly of claim 17, wherein a metalized vapor barrier is applied to outer surfaces of adjacent vapor barrier sections to seal a seam between the adjacent vapor barrier sections.

19. A thermoelectric assembly comprising:

a thermoelectric module having a hot side and a cold side;

a heat sink coupled with the hot side of the thermoelectric module;

a cold sink coupled with the cold side of the thermoelectric module;

a gasket disposed between the heat sink and the cold sink and extending around a portion of the thermoelectric module; and a vapor barrier disposed at and covering an outer peripheral surface of the gasket, wherein the vapor barrier comprises a ceramic material and has zero permeability to water vapor to prevent water vapor from penetrating the outer surface of the gasket, wherein the vapor barrier is attached at the outer surface of the gasket and extends between the heat sink and the cold sink.

20. The thermoelectric assembly of claim 19, wherein the gasket comprises a foam gasket and wherein a sealant is disposed between the vapor barrier and the outer peripheral surface of the gasket to attach the vapor barrier to the gasket.

21. The thermoelectric assembly of claim 19, wherein the vapor barrier comprises multiple sections.

22. The thermoelectric assembly of claim 19, wherein the vapor barrier further comprise a glass material.

23. The thermoelectric assembly of claim 19, an exterior protective coating is disposed over the vapor barrier or a metalized vapor barrier layer is applied to an outer surface of the vapor barrier.

* * * * *